US005299673A

United States Patent [19]

Wu

[11] Patent Number: 5,299,673

[45] Date of Patent: Apr. 5, 1994

[54] COIN RECEIVING MECHANISM HAVING A FOREIGN OBJECT RELEASE DEVICE

[75] Inventor: Edward S. Wu, Freemont, Calif.

[73] Assignee: Tatung Telecom Corporation, Mountain View, Calif.

[21] Appl. No.: 714,932

[22] Filed: Jun. 13, 1991

[51] Int. Cl.[5] ..... G07F 1/04

[52] U.S. Cl. ..... 194/345; 194/349; 194/351

[58] Field of Search ..... 194/321, 323, 345, 346, 194/347, 349, 351, 344

[56] References Cited

U.S. PATENT DOCUMENTS 4,660,706 4/1987 Wollet ..... 194/351
4,687,090 8/1987 Ramseier ..... 194/351 X

FOREIGN PATENT DOCUMENTS 3538717 5/1987 Fed. Rep. of Germany ..... 194/351
2-76094 3/1990 Japan ..... 194/345
1334157 10/1973 United Kingdom ..... 194/345

*Primary Examiner*—F. J. Bartuska

*Attorney, Agent, or Firm*—Ladas & Parry

[57] ABSTRACT

The invention is a coin receiving mechanism having a foreign object release device for use with a coin receiving machine having a coin acceptor/counter device. The invention has a pair of hinged coin chute walls with planar sections arranged in a zigzag manner which define the coin path. The coin chute walls also have a section angled from the zigzagged sections. A cam member is connected by linking arms to the coin chute walls. A coin return lever on the outline of the machine is connected to a drive arm inside the machine. When turned, the coin return lever turns the cam member and causes the coin chute walls to flip open and eject any foreign objects contained therebetween. The drive arm is connected to the coin return lever through a clutch mechanism. A coin shutter with a coin slot is also operated by activating the cam member which causes the coin shutter to misalign the coin slot in the coin shutter with the coin receiving slot on the outside of the coin receiving machine, thereby preventing additional foreign objects and/or instruments from being introduced into the coin chute.

21 Claims, 8 Drawing Sheets

COIN RECEIVING MECHANISM HAVING A FOREIGN OBJECT RELEASE DEVICE

BACKGROUND OF THE INVENTION

1. Field of the Invention

The invention relates to a coin receiving mechanism for use with pay telephones, vending machines, coin changing machines and other coin or token activated machines, and more particularly, to a coin receiving mechanism having a foreign objects release device for releasing foreign objects jammed in the coin receiving mechanism.

2. Description of the Prior Art

A major problem associated with coin receiving mechanisms used in pay telephones, vending machines, change machines and the like is their susceptibility to being intentionally jammed by a thief intent on stealing subsequently deposited coins. The thief stuffs paper, cloth, or other foreign objects into the coin deposit chute which blocks the coin acceptor/counter device associated with the coin receiving mechanisms. After setting his trap, the thief waits until one or more paying customers have deposited coins in the coin deposit chute blocked by the foreign objects. Since the deposited coins are blocked by the foreign objects, these coins cannot be retrieved by operating the coin release lever or tapping on the coin activated machine. After the paying customer leaves, the thief returns to complete the theft by attempting to fish out the coins stuck in the coin deposit chute with a wire, comb or other instrument. In fishing out the coins, the thief often will cause further jamming and/or damage to the coin receiving mechanism and the coin acceptor/counter device. Typically, the thief will leave the foreign objects in the coin receiving mechanism, resulting in an ongoing loss of sales from the machine and requiring repair personnel to make a service call to remove the blockage. Such illegal activity not only inconveniences and upsets the customer of the coin operated machine, but also results in substantial economic loss to the owners and operators of coin operated machines by way of lost sales and higher repair costs.

Several attempts have been made to overcome the above identified problem, but they have all met with limited success. U.S. Pat. No. 4,660,706 to Wollet teaches a mechanism with a metal plate which blocks the coin deposit slot on the coin activated machine if foreign objects are stuffed between the walls of the coin chute, and thereby prevents the additional foreign objects and/or coins from being deposited. However, the Wollet device does not provide any feature which would allow the customer to clear the blockage. With the Wollet device, once the coin chute is stuffed with foreign objects, a metal plate shuts the coin deposit slot on the coin activated machine, thereby blocking further access to the coin deposit chute and rendering the coin activated machine inoperative. Although later customers are prevented from losing their coins to thieves, sales are lost until service personnel make a service call to clear the machine. U.S. Pat. No. 4,687,090 to Ramseier discloses a coin receiving mechanism having separable coin guide walls which define a coin track having sections arranged in a zigzag form. While the Ramseier device purportedly has a feature to allow unblocking of the coin chute path, one of the walls, which is set at a steep angle to the vertical, does not move and thus it cannot "kick" debris out of the coin path. Thus, the Ramseier device can require at least several operations to clear paper jams.

SUMMARY OF THE INVENTION

The invention disclosed herein solves the problems outlined above by providing a unique and novel mechanism which includes separable coin chute walls defining a coin chute path, which when separated by turning the coin return lever on the coin operated device, for example, cause objects lodged between the coin chute walls to be ejected, thereby clearing foreign objects from the coin chute path and the coin acceptor/counter device.

When the coin chute path of the instant invention is stuffed with paper or other foreign objects, thereby blocking the coin chute path through which coins normally traverse, the coin activated machine will not operate. The paying customer will invariably turn the coin return lever on the coin activated machine, thereby separating the coin chute walls and ejecting the foreign objects to clear the coin chute path. Turning the coin return lever turns a drive arm, which then rotates a cam member coupled to the two walls of the coin chute by drive arms, causing the walls to separate at their bottom portion. One of the walls swings out wider than the other, thereby flipping and ejecting any foreign objects and coins previously jammed therebetween into a waste receiver. Thereafter, when the coin release lever is released, the two walls of the coin chute spring back to their unactivated position of being parallel in a vertical plane, free from any blockage and immediately available for use. The coin release mechanism may also include a coin shutter with a coin slot passing therethrough. The coin shutter moves to block the coin accepting slot on the outside of the machine when the coin release lever is activated and/or the walls of the coin chute are spread apart because of the presence of foreign objects or tools inserted therebetween, thereby preventing further jamming of foreign articles therein and further loss of coins by a paying customer.

Ideally, the walls of the coin chute path are manufactured with several planar sections, each arranged in a zigzagged orientation in one direction with respect to each other. At least one planar section is arranged at an angle offset from the direction of the zigzagged sections. This zigzagged and turned arrangement of planar sections helps prevent a wire or other instrument from being inserted very far down into the coin path defined by the walls. The inside of the wall sections preferably have parallel grooves and ribs defined thereon in the same direction of coin travel. These grooves and ribs help prevent wet coins from sticking in the coin chute path, and also help prevent a wire or other instrument from being inserted into the mechanism and negotiated through the space between the zigzagged and angled wall sections, to the end of the sections. Groups of groove blocks are preferably located at various positions in the grooves between the ribs on the inside of the coin chute walls, which groove blocks help to catch on inserted wires or tools, thereby further frustrating attempts by the thief to push foreign objects into the coin chute path.

BRIEF DESCRIPTION OF THE DRAWINGS

The invention as described below in greater detail with reference to the drawings.

DETAILED DESCRIPTION

Figure 1:
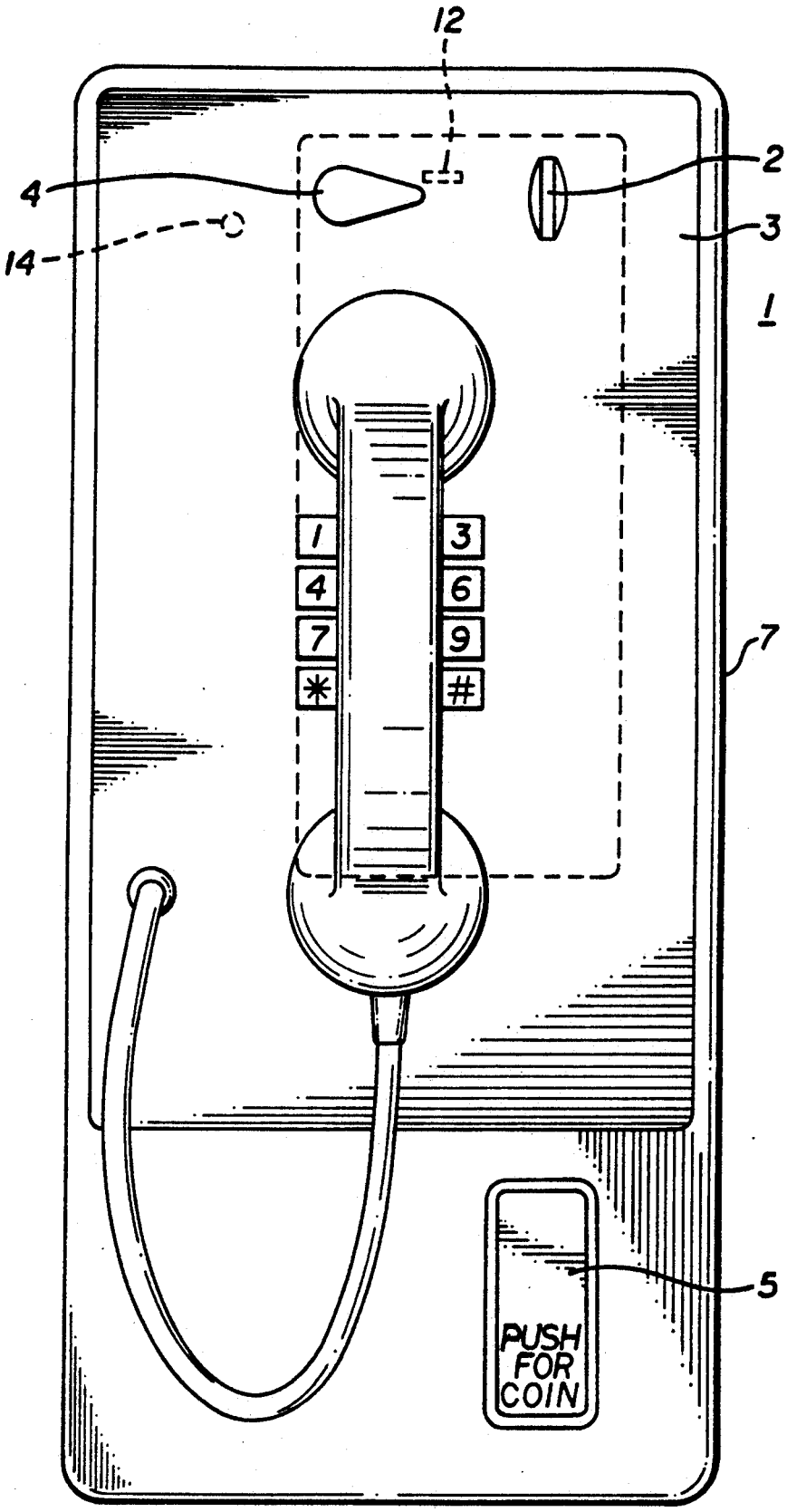
FIG. 1 is a front view of a coin operated telephone with the location of the coin receiving mechanism having a foreign object release device outlined by dotted lines.

Referring first to FIG. 1, the front of a coin operated telephone 1 is shown. The telephone has a coin slot 2 which passes through the front panel 3 of the telephone. The coin return lever 4 is located on the front panel 3 of the telephone. The coin return door 5 is located at the bottom of the telephone front panel 3 of the telephone. The coin activated mechanism having a foreign object release device is located behind the front panel 3 in the vicinity of the dotted lines. A case 7 houses the coin activated mechanism and the electronics associated with the telephone's communication facilities. For sake of convenience, the mechanism is shown and discussed as used in a coin operated telephone, but the mechanism is equally applicable to other coin operated machines.

Figure 2:
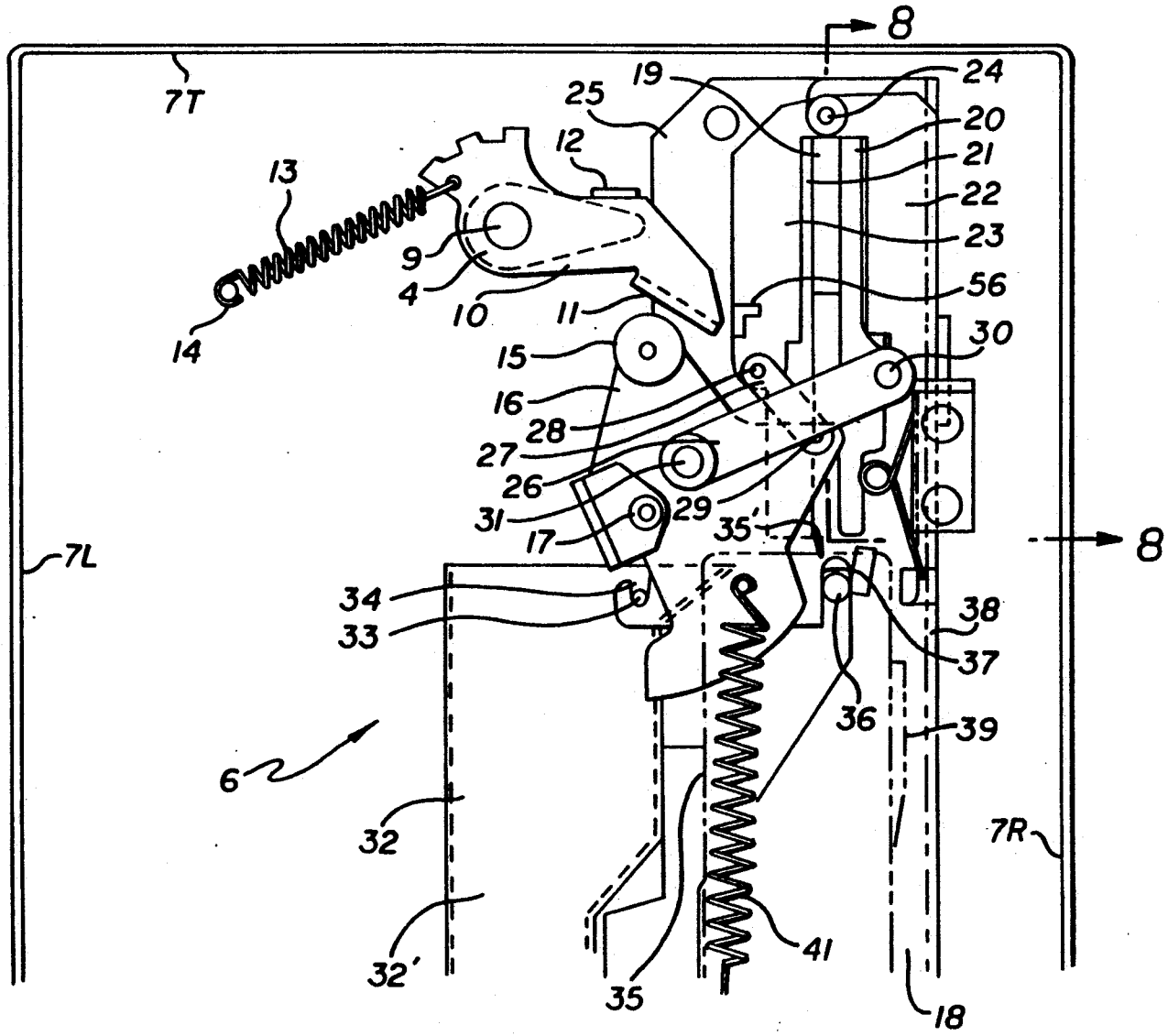
FIG. 2 is a front view of a coin receiving mechanism using the present invention showing the mechanism in its non-activated position, partially cut open to shown the parts thereof, in conjunction with a coin acceptor/-counter device, shown in phantom lines.
Figure 3:
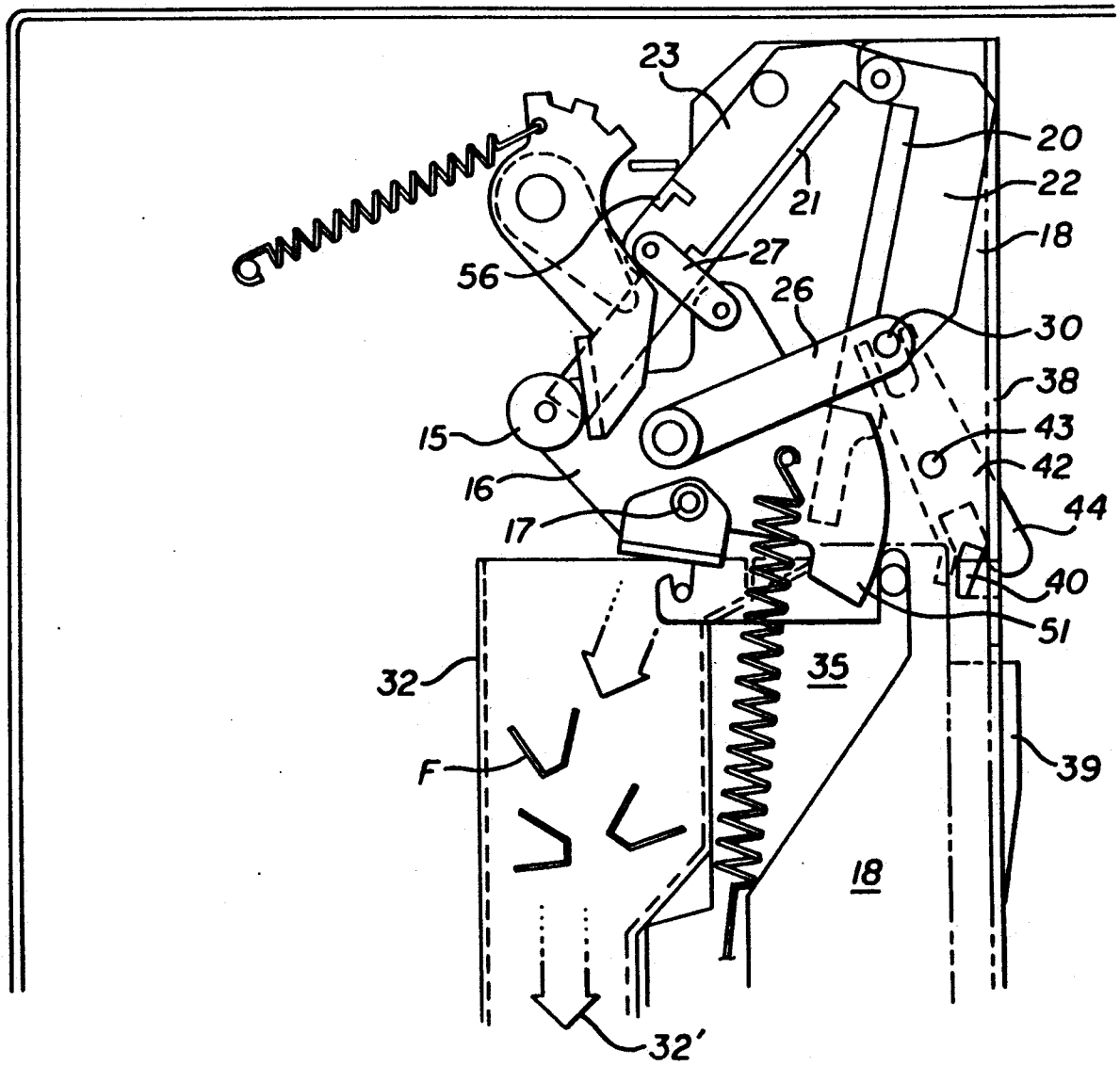
FIG. 3 is a front view of the coin receiving mechanism in its activated position, partially cut open to show the parts thereof, in conjunction with a coin acceptor/-counter device, shown in phantom lines.
Figure 4:
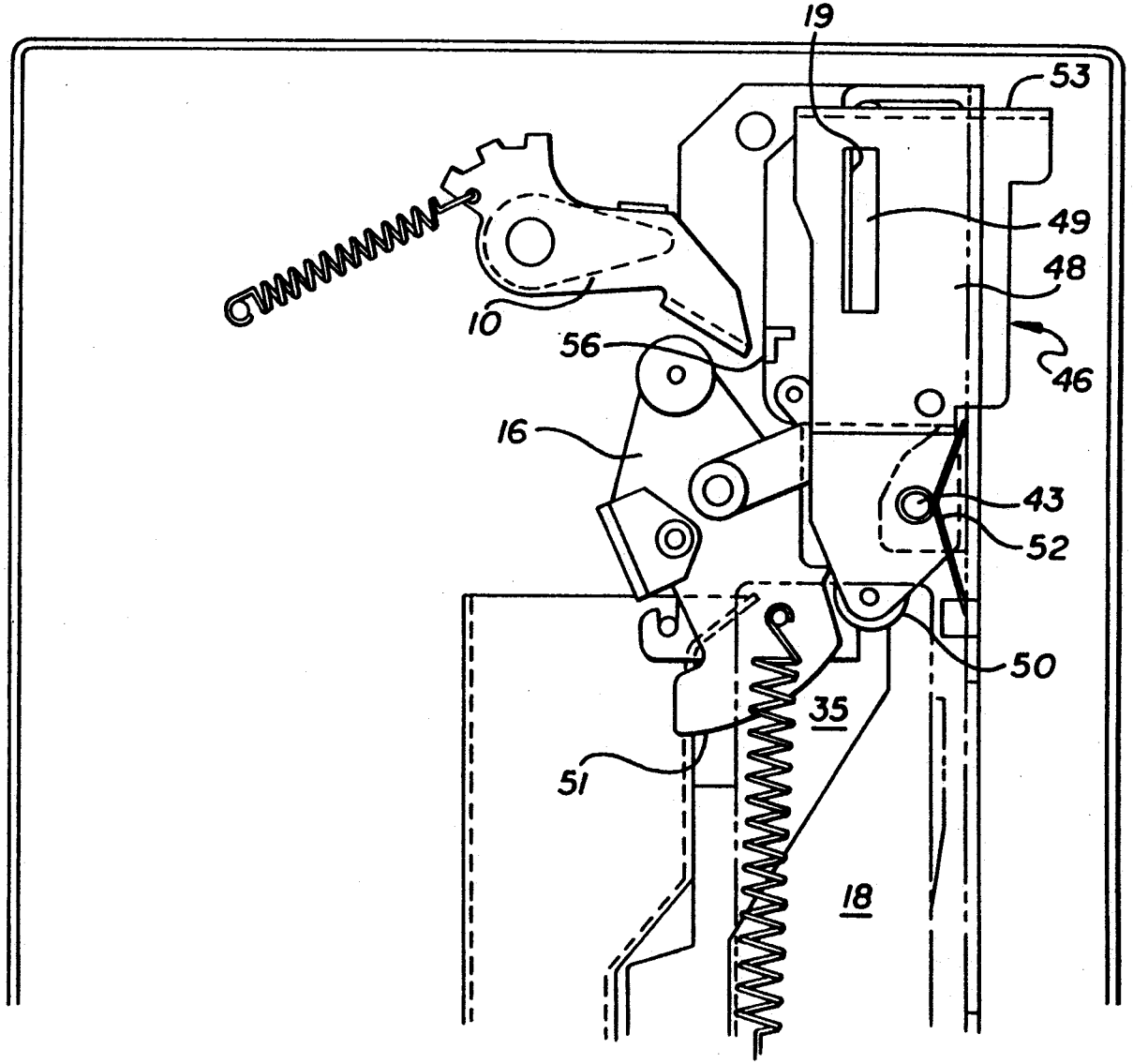
FIG. 4 is an front view of the coin receiving mechanism in its non-activated position, with the coin shutter being shown.
Figure 5:
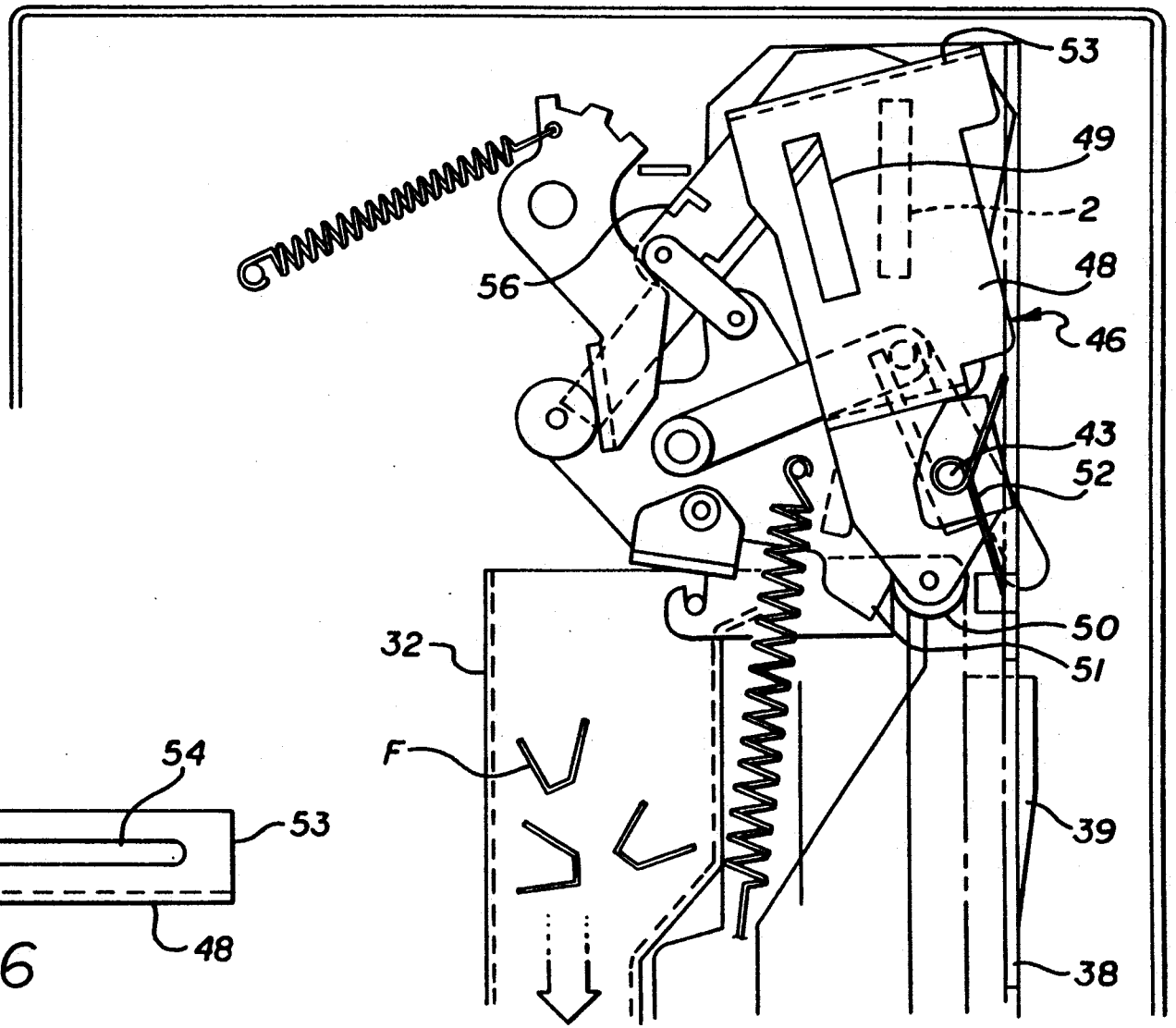
FIG. 5 is a front view of the coin receiving mechanism in its activated position, with the coin shutter being shown.

Referring next to FIGS. 2 and 3, the coin receiving mechanism having a foreign object release device is generally shown by reference numeral 6 and is shown with the front panel 3 of the telephone removed. As will be subsequently discussed, it is also shown without a shutter device which will be described subsequently with reference to FIGS. 4 and 5.

The coin return lever 4, shown in dashed lines, is present on the front panel 3 of the coin operated telephone 1 and the top 7T and side walls 7R and 7L of the case 7 can be seen. The coin return lever 4 is journalled to a shaft 9. A drive arm 10 is connected either directly to the shaft 9, or indirectly through a spring, as will be described more fully below. The drive arm 10 has a contact surface 11 at one end. Positioned on the inside of front panel 3 of the telephone is a stop 12 which prevents the drive arm 10 from moving beyond its unactivated position. A biasing spring 13 is connected at one end to the drive arm 10, and at the other end to a retaining post 14 fixed on the inside of the front panel 3 of the telephone. The biasing spring 13 keeps the drive arm 10 pressed against the stop 12 when the coin return lever 4 is in its unactivated position. When the coin return lever 4 is turned, the drive arm 10 moves in a path to make contact with a roller 15, rotatably mounted on a member 16, which is rotationally mounted on pivot pin 17, which in turn is mounted to a front wall 18 of a generally U-shaped frame supporting the coin receiving mechanism 6. A side wall of the frame can be seen at numeral 38, which side wall continues rearwardly as a rear wall 38 generally of similar configuration to front wall 18, except that it need not make room for coin chute 19.

Figure 8:
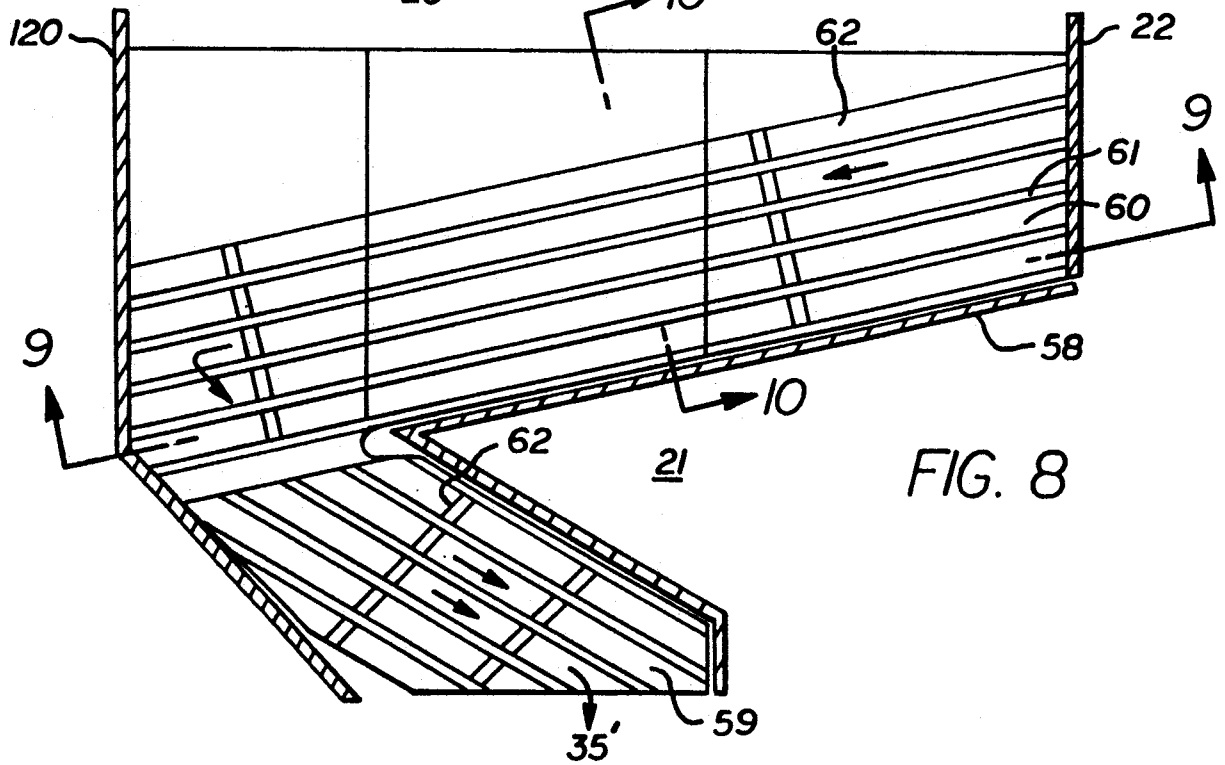
FIG. 8 is a side elevational view of the first coin chute wall.

The coin receiving slot 2 on the outside case 7 of the telephone 1 aligns with an entrance of coin chute 19, the coin chute providing a path for deposited coins, which path is defined by the inside surfaces of a right coin chute wall section 20 and a left coin chute wall section 21 which in their unactivated positions lie parallel to each other in a vertical position as shown in FIG. 2. Connected approximately perpendicular to the front of the right and left wall sections 20 and 21 are right and left front wall plates 22 and 23, respectively. Also connected approximately perpendicular to the rear of the right and left wall sections 20, 21 are left rear wall plate 120 and right rear wall plate 121, as shown in FIG. 8.

The right coin chute wall section 20 and left coin chute wall section 21 are pivoted together at their top portions on a pivoting shaft 24. The pivoting shaft 24 passes through and is supported by the front wall 18 and by a bracket (not shown) attached to side wall 38 of the frame supporting the mechanism 6. A bottom portion of the right front wall plate 22 is pivotally connected to member 16 via a right wall link 26 and the bottom portion of the left front wall plate 23 is pivotally connected to the cam member 16 by a left wall link 27. The left wall link 27 is pivotally connected to the left front wall plate 23 at pin 28 and to member 16 at pin 29. The right wall link 26 is pivotally connected to the right front wall plate 22 at pin 30 and to member 16 at pin 31, which is closer to pin 17 than is pin 29. A debris receptacle 32 is hung by hanging pins 33 on slots 34 on the front wall 18 of the frame and rear wall 25 of the frame. It has a chute 32' which conveys debris and trapped coins to the coin return slot 5. When the coin return lever 4 is depressed, the drive arm 10 moves to drive its contact surface 11 into contact with roller 15 on member 16, causing member 16 to rotate in a counter-clockwise direction about pin 17, thereby opening the coin chute mechanism as shown in FIG. 3. As member 16 rotates, the left wall link 27 and right wall link 26 cause the left wall section 21 and right wall section 20 to swing open at their bottoms. By virtue of the left wall link 27 being pivoted at a pin 29 further away from the pin 17 than is pin 31 of the right wall link 26, the left wall section 21 swings out wider than does the right wall section 20. The foreign objects F previously inserted into the coin chute path are then ejected into debris receiver 32 and thence to slot 5.

A coin acceptor/counter device 35 of conventional design, shown mostly in phantom lines, has tabs 36 which slide into receiving slots 37 on the front and rear walls 18, 25 of the supporting frame. The front and rear walls 18, 25 are joined to a side wall 38 of the frame. Additional tabs (not shown) may be used to hold the bottom of the coin acceptor/counter device 35 in place in the frame supporting the mechanism. The coin ancestor/counter device 35 has an opening 35' for coins exiting the coin chute 19 formed by wall sections 20 and 21. It also has a release door 39, which when relieved by pushing on release door member 40, (as shown in FIG. 3) releases any coins that may have become jammed in the coin acceptor/counter device 35, moving through an opening in side wall 38. A coil spring 41 is attached at its upper end to the lower portion of member 16 and at its lower end to the front wall 18 (not shown). Two tension springs (not shown) are preferably also used to further exert a counter-clockwise twisting force on wall sections 20 and 21 to urge the wall sections 21 and 20 to return to their normal unactivated position when the coin return lever 4 is released.

As shown in FIG. 3, a rocker member 42 is pivoted in its middle portion on a rocker member pivot pin 43 which is mounted on the front wall 18 of the supporting frame. At its upper end, the rocker member 42 has a forked portion which is slidingly connected to pin 30 at which the right wall link 26 pivotally connects to the bottom of the right front wall plate 22. The bottom of the rocker member has a forked portion 44. The release door member 40 of the release door 39 slides between the prongs of the forked portion 44 of the rocker member 42.

When the coin release mechanism 6 is activated, the right wall section 20 swings out at its bottom in a clockwise direction, causing the rocker member 42 to pivot about its pivot pin 43 in a counter-clockwise direction, which in turn pushes the release door member 40, causing the release door 39 to open, thereby freeing coins lodged in the coin acceptor/counter device 35. The release doors 39 of the coin acceptor/counter device 35 is conventionally spring loaded, which applies a clockwise turning force to the rocker member 42 to help return it and the entire mechanism to its unactivated position when coin lever 6 is released.

Link 26, being coupled relatively closely to pin 17 on member 16, operates with a relatively large torque, thereby making it effective for dislodging any debris stuck in the mouth 35' of coin acceptor/counter 35.

The mechanism preferably includes a coin shutter device 46. One embodiment thereof is now disclosed with reference to FIGS. 4, 5 and 6. The coin shutter 46 is pivoted on the rocker member pivot pin 43 which is mounted on the front wall 18 of the frame. The coin shutter 46 preferably has a flat planar face 48 with a coin shutter slot 49 passing therethrough, positioned above the pivot pin 43. When the mechanism is in its unactivated position, best shown in FIG. 4, the coin shutter slot 49 aligns with the entrance of the coin chute 19 and the coin slot 2 on the outside of the telephone 1.

A shutter roller 50 is pivotally mounted at the bottom portion of the coin shutter 46. Member 16 has a lower curved lobe cam portion 51 which provides a cam surface for roller 50. When the coin receiving mechanism 6 is activated by turning the coin return lever 4 or the right wall section 20 and left wall section 21 of the coin chute are physically separated, e.g., by insertion of foreign objects or prying with tools, member 16 is rotated in a counter-clockwise direction, driving its lower curved lobe cam portion 51 into contact with the shutter roller 50, which in turn causes the coin shutter 46 to rotate in a counter-clockwise direction. As the coin shutter 46 turns on its pivot pin 43, the coin shutter slot 49 is moved out of alignment with the coin receiving slot 2 on the outside of the telephone 1, thereby preventing the thief from introducing any further foreign objects or tools into the coin receiving mechanism 6 or attempting to break the machine. This also tends to prevent customers from attempting to insert coins in a debris jammed machine. A shutter return spring 52 is positioned on pivot pin 43 which biases the coin shutter 46 to return to its unactivated position.

Figure 6:
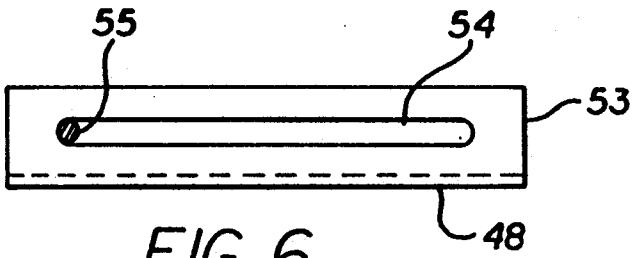
FIG. 6 is top view of the coin shutter.

As shown in FIG. 6, the top of the coin shutter 46 has a top portion 53 normal to flat planar face 48 of the coin shutter 46. The top portion 53 has an elongated slot 54 formed therein. The elongated slot 54 does not reach either end of the top portion. A shutter keeper post 55 is positioned on the front wall 18 and juts upward into the elongated slot 54. In the unactivated position where the coin shutter 46 aligns with the coin receiving slot 2 on the outside of the telephone 1, the shutter keeper post 55 abuts the left end of the elongate slot 54, preventing the coin shutter 46 from being moved any further to the right. When the coin chute mechanism moves to the position shown in FIGS. 3 and 5, the coin shutter 46 moves counter-clockwise direction and is stopped by the contact of the shutter keeper post 55 on the right side of the elongate slot 54. Due to the configuration of member 16 in relationship to the coin shutter 46, particularly the contour of the lower curved lobe cam portion 51, the coin shutter 46 does not return to its normal unactivated position until member 16 is at the last portion of its return motion.

Member 16 is configured such that the right and left walls section 20 and 21 of the coin chute and the release door 39 of the coin acceptor/counter device 35 operate or move in unison. If either the coin acceptor/counter device 35 or the right and left walls section 20 and 21 are jammed and cannot return to their unactivated position, then member 16 will not return to its unactivated position, thereby preventing the coin shutter slot 49 from returning to its normal position in alignment with the coin receiving slot 2 on the outside of the telephone 1. This feature saves further losses of coins by paying customers and will prevent further thefts from occurring.

Figure 7:
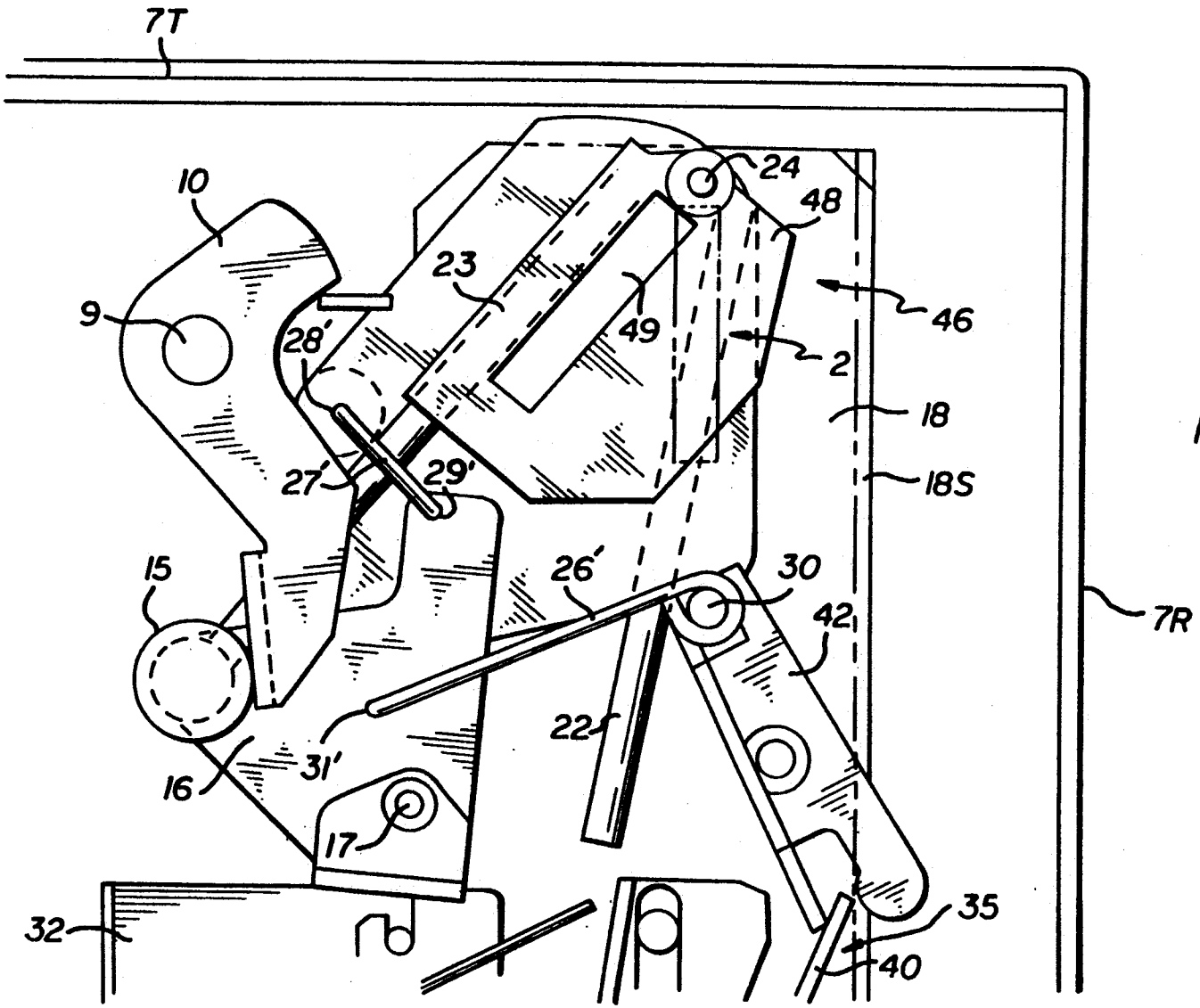
FIG. 7 is a partial front view, similar to FIG. 5, of a lower cost version of coin receiving mechanism.

An abutting member 56 is located on the left front wall plate 23 and juts outwardly to a position behind the contact surface 11 of the drive arm 10. The abutting member 56 makes it impossible to pry the right and left walls section 20 and 21 substantially apart since if an attempt is made to pry them apart, the abutting member 56 is stopped by drive arm 10. In the embodiment of FIGS. 2-6, links 26 and 27 are provided by flat elongated plates having openings at the ends thereof which rotate on pins 28, 29, 30 and 31. In order to reduce the manufacturing cost of the coin receiving mechanism, elongated wire links 26' and 27' are preferably used instead of the elongated plates, as is shown in FIG. 7. The wire links 26' and 27' are bent at their ends either to be received in openings 28', 29' and 31' located where pins 28, 29 and 31 are shown in FIG. 2, for example, or to wrap around a pin, such as pin 30, as shown in FIG. 7.

Also, to further lower the manufacturing cost of the coin receiving mechanism, the coin shutter device is preferably rotationally mounted on pin 24 and is coupled to wall 23 so that the slot 49 therein rotates clockwise out of alignment with coin slot 2 in response to the rotation of member 16.

Figure 9:
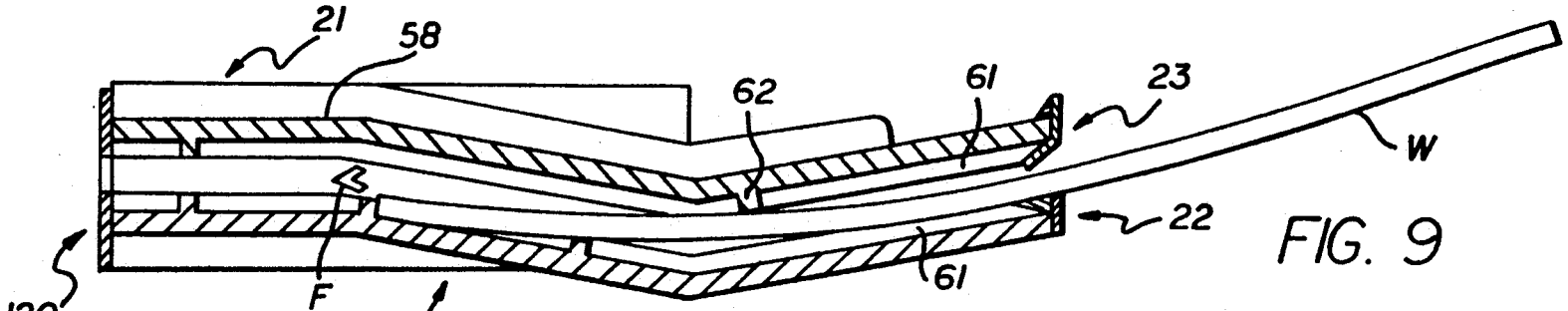
FIG. 9 is a bottom view of the coin chute walls generally taken through view lines 9—9 of FIG. 8.
Figure 10:
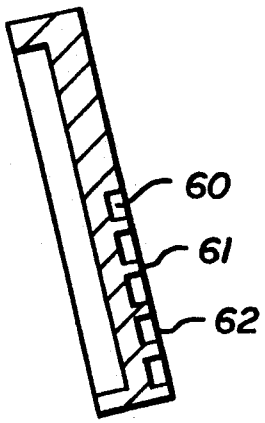
FIG. 10 is a cross sectional view of the second coin chute wall taken through view lines 10—10 of FIG. 8.

The coin chute is shown in greater detail in FIGS. 8-10. FIG. 8 is a side elevational view of wall plate 22, generally taken along line 8—8 of FIG. 2, but without showing the links and other mechanics which impart motion to wall 22. As can be seen from FIG. 9, the right wall section 20 and left wall section 21 lie parallel to each other and have a plurality of planar, normally vertical sections 58 offset at slight angles from each other, so that the walls have a zigzagged configuration. The space between the wall sections 20 and 21 partially define the coin chute 19 and thus the coin follows a zig zag pattern to the coin counter/acceptor 35. Indeed, the zig zag occurs in two ways, the deposited coins zigzag right and left while moving generally aftward and then change direction and move generally forwardly.

Guide walls 58 define the bottom and sides of the coin chute upon which the coins being deposited (and following the arrows) roll. The right and left wall sections 20 and 21 of the coin chute in its unactivated (normal) position lie in vertical planes so that the coins being deposited roll on the guide walls 58 as they zig zag rearwardly down the chute 19.

In the preferred embodiment, both the right and left wall sections 20 and 21 of the coin chute have a lower section 59 turned at an angle from the sections arranged in the first mentioned zigzag. The right and left wall sections 20 and 21 preferably have grooves 60 formed thereon which define ribs 61 at least partially thereon, with the grooves and ribs located in the direction of coin travel, shown by arrows.

FIG. 10 shows the arrangement of grooves 60 and ribs 61. The ribs 61 prevent wet coins from sticking to the walls 20 and 21 of the coin chute. Groove blocks 62 are preferably located at various positions in the grooves 60 to block the spaces between the ribs. FIG. 9 is taken through a groove 60 to show more clearly groove blocks 62. When wires or other instruments are inserted into the coin chute in an attempt to force foreign objects F into the coin chute, the wire W will tend to follow a groove or grooves 60, and due to the zig zag configuration, will be caught up on one or more groove blocks 62, preventing the foreign object F from being forced further down into the coin chute. The lower section 59 of the coin chute also has grooves 60 defining ribs 61 thereon in the direction of coin travel. Groove blocks 62 are also preferably located in the grooves thereon. The combination of the zigzagged right and left wall section 20 and 21 with the lower section 59, grooves 60, ribs 61 and groove blocks 62 effectively defeat the thief's attempt to force foreign objects F very far down into the coin chute path or around the turn in the coin chute into the coin acceptor/counter device 35.

Figure 11:
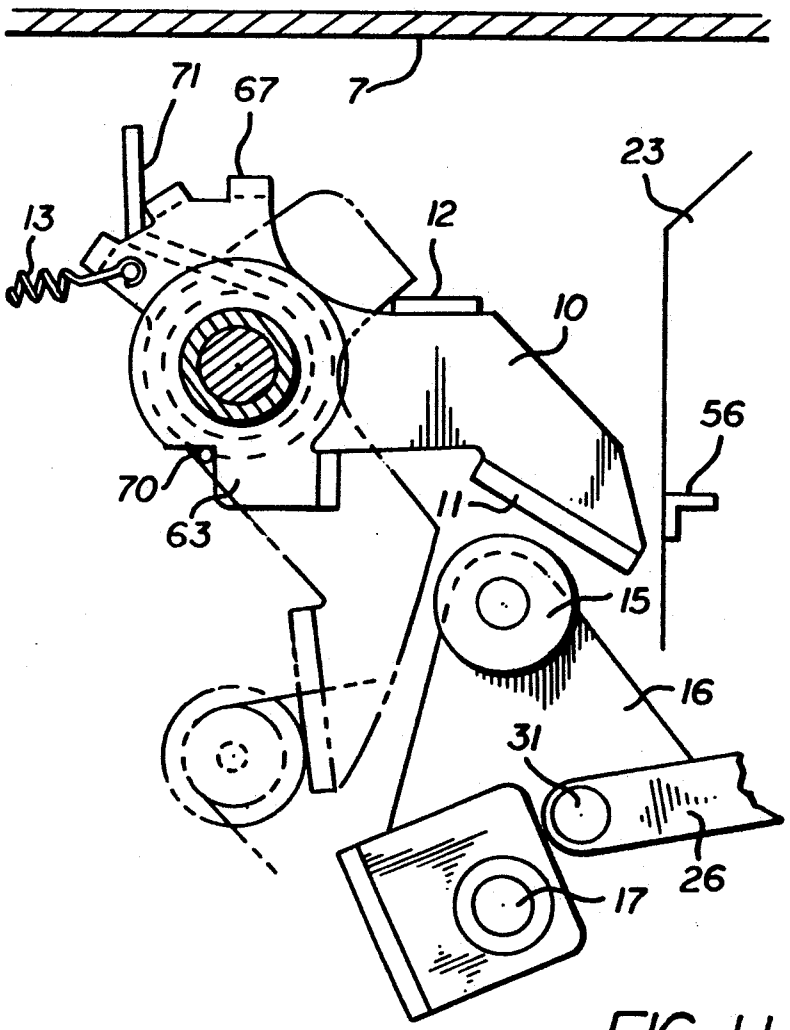
FIG. 11 is a front view of the coin return lever mechanism, partially cut open to shown the details therein.
Figure 12:
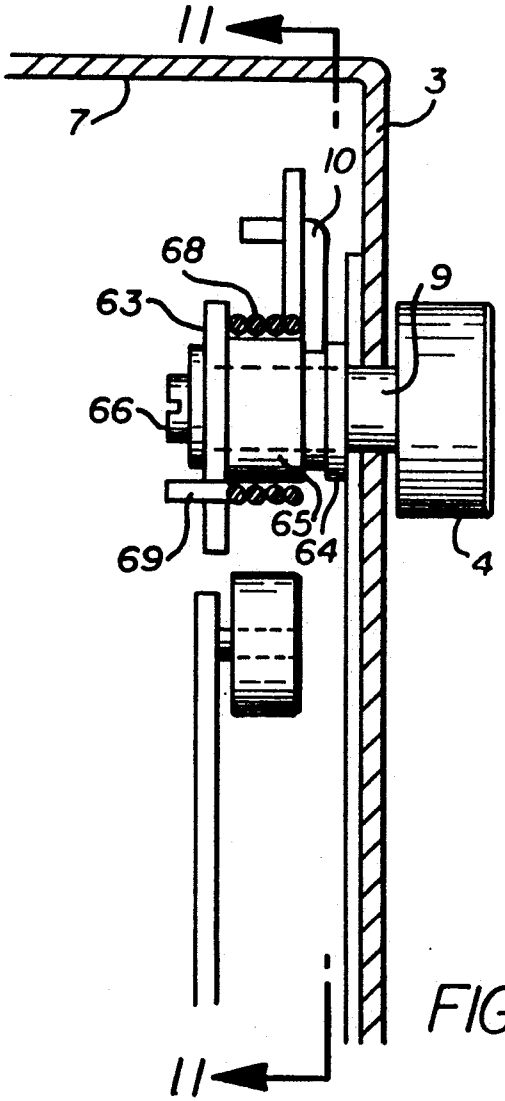
FIG. 12 is a side view of the coin return lever mechanism of FIG. 11, taken through view lines 11—11.

Another feature of the invention is shown in FIGS. 11 and 12. The coin return lever 4 is rigidly connected to shaft 9 which is affixed to a drive arm plate 63, by a bolt, screw, or other well known attachment means. Located behind the front panel 3 of the telephone 1 is washer 64. The drive arm 10 is rotatably sandwiched between the washer 64 and a bobbin 65 placed between the drive arm plate 63 and the drive arm 10 on the shaft 9. A bolt 66 or other means fixes the drive arm plate 63 to the shaft 9 so that the drive arm plate 63 does not rotate relative to the coin return lever 4. The drive arm 10 has ears 67 at its top. A torsion spring 68 is placed around the bobbin 65. The lower end of the torsion spring 69 fits into a corner edge 70 of the drive arm plate 63 and the upper end of the torsion spring 71 is retained by the ears 67. The tension on the torsion spring 68 may be adjusted by the choice of which ears 67 are used to retain the upper end 71 of the torsion spring 68.

As described, the coin return lever 4 communicates with the drive arm 10 via the torsion spring 68. Thus, the combination acts as a clutch mechanism and prevents excess force from being applied to the cam roller 15 and thereby causing damage to the coin receiving mechanism 6 in case the coin return lever 4 is violently turned in an attempt to break the mechanism. If excess force is applied to the torsion spring 68 via the coin return lever 4, the torsion spring 68 will "give", thereby preventing damage to the coin receiving mechanism 6. FIGS. 11 and 12 show the drive arm 4 and member 16 and related parts in their activated position by phantom lines.

The drawings and foregoing description are not intended to represent the only form of the invention in regard to the details of its construction and manner of operation. In fact, it will be evident to one skilled in the art that modifications and variations may be made without departure from the spirit and scope of the invention. For example, FIG. 7 depicts a lower cost and preferred embodiment of the mechanism which impart motion to walls 22 and 23. Changes in form and in proportions of parts, as well as the substance of equivalents are contemplated as circumstances may suggest or render expedient. Although specific terms have been employed, they are intended in a generic and descriptive sense only and not for the purpose of limitation, the scope of the invention being detailed in the following claims:

The invention is claimed as follows:

1. A coin receiving mechanism having a foreign object release device for use with a coin receiving machine, said mechanism comprising:

first and second hinged coin chute walls, each having an inner surface and an upper and lower portion, said coin chute walls having a plurality of planar sections, said planar sections lying in different planes to define a zigzagged coin chute path through which a coin travels, said coin chute walls being pivoted to swing open wider at their lower portion than at their upper portion, each of said coin chute walls further having a lower planar section which has a coin path which is angled with respect to a coin path defined by said planar sections arranged in different planes.

2. The coin receiving mechanism of claim 1 wherein said inside surface of said coin chute walls have a plurality of parallel grooves and ribs defined thereon, said parallel grooves and ribs being positioned parallel to a path which a coin takes through said coin chute.

3. The coin receiving mechanism of claim 2 wherein said plurality of grooves have a plurality of groove blocks positioned at various positions therein to block the grooves between the ribs.

4. A coin receiving mechanism having a foreign object release device for use with a coin receiving machine, said mechanism comprising:

(a) first and second hinged coin chute walls, each having an inner surface and an upper and lower portion, said inner surfaces of the coin chute walls defining a coin chute path through which a coin travels;

(b) a coin return lever and a drive arm with a contact surface, said drive arm being journalled to said coin return lever; and (c) a wall spreading mechanism for moving said hinged coin chute walls from an unactivated position with the walls lying essentially parallel to each other, to an activated position where the walls are swung open to eject foreign objects caught between said walls to thereby clear said coin chute path, said wall spreading mechanism including:

a member rotationally mounted on a frame of said mechanism at a pivot pin, said member having a roller rotatably mounted thereto and a cam portion;

a first link having two ends, said first link being pivotally connected at its first end to said member and pivotally connected at its second end to a lower portion of said first coin chute wall; and a second link having two ends, said second link being pivotally connected at its first end to a member and pivotally connected at its second end to a lower portion of said second coin chute wall, said first link being pivotally connected to said member at a point closer to said pivot pin than is said second link, said wall spreading mechanism being activated when said coin return lever is rotated, thereby driving said contact surface of said drive arm into contact with said roller, turning said member on its pivot pin, causing said first and second links to swing said first and second wall sections apart from each other, said second coin chute wall chute being swung further than said first wall section and thereby ejecting foreign objects previously located between said first and second wall sections.

5. The coin receiving mechanism of claim 4, wherein said coin return lever means further comprises a drive arm plate, a shaft connecting said coin return lever rigidly to said drive arm plate, a stop located on an inside surface of a machine equipped with the coin receiving mechanism, and a torsion spring, and whereby said drive arm is rotatably located on said shaft, said torsion spring connects said drive arm to said drive arm plate, allowing said torsion spring to absorb excess force and thereby preventing damage to said mechanism in the event the coin return lever is operated with excess force.

6. The coin receiving mechanism of claim 4, further comprising a coin shutter means, said coin shutter means having a surface with a coin slot defined therein, a shutter roller at its bottom portion, said coin shutter being pivoted at a pivot point, and a spring means to bias said coin shutter to return to a position aligning said coin slot in said coin shutter with a coin slot located on the front of the coin receiving machine, wherein when said member is activated by being rotated, said lower curved lobe portion makes contact with said shutter roller, thereby causing said coin shutter to rotate on its pivot point and move said coin slot in said coin shutter out of alignment with the coin slot on the coin receiving machine, thereby preventing additional foreign objects from being introduced into said coin chute.

7. The coin receiving mechanism of claim 4 further comprising a pivoted rocker member, said rocker member being pivotally connected at one end to said second end of said first link, said rocker being pivoted at a center portion to said frame, and said rocker member connecting with and activating a release door of a coin acceptor/coin counter device when said mechanism is activated.

8. The coin receiving mechanism of claim 4 wherein said hinged coin chute walls lie in a vertical plane in their unactivated position to define a coin chute path lying in at least one vertical plane.

9. A coin receiving mechanism having a foreign object release device for use with coin receiving machines and with a coin acceptor/counter device, comprising:

a mounting frame having a front wall, a side wall and a rear wall;

a coin chute having first and second coin chute walls with a top and bottom portion and having an inner surface, said coin chute walls being pivoted at said top portion by a rod bridging said front and rear walls of said mounting frame, said first and second coin chute walls each having a plurality of planar sections, at least two of which lie in a first direction in different planes and at least one of said planar sections lying in a second direction offset at an angle from said first direction to define a zigzagged and angled coin chute path;

a coin return means having a coin return operator and a drive arm with a contact surface, said drive arm being activated by said coin return operator; and a wall spreading means activated by turning said coin return operator to cause said first and second coin chute walls to move from an unactivated position with the coin chute walls disposed parallel to each other to an activated position wherein the coin chute walls open at their bottom portions, said second coin chute wall swinging open more widely than said first coin chute wall, such movement causing foreign objects caught therebetween to be ejected from between the walls, thereby clearing the coin chute path.

10. The coin receiving mechanism of claim 9 wherein said wall spreading means comprises:

a member pivoted on said front wall of said mounting frame on a pivot pin, said member having a roller rotatably mounted thereto and a lower curved lobe cam portion;

a first link having two ends, said first link being pivotally connected at its first end to said member and pivotally connected at its second end to said lower portion of said first coin chute wall; and a second link having two ends, said second link being pivotally connected at its first end to said member and pivotally connected at its second end to said lower portion of said second coin chute wall, said first link being pivoted to said member closer to said pivot pin than it is pivoted said second link; said wall spreading means being activated when said coin return means is operated, which drives said contact surface of said drive arm into contact with said roller, turning said member on its pivot pin, causing said first and second links to swing said first and second wall sections open, said second coin chute wall chute being swung further than said first wall section, thereby ejecting foreign objects previously located between said first and second walls.

11. The coin receiving mechanism of claim 10, wherein said coin return means further comprises a drive arm plate, a shaft connecting said coin return operator rigidly to said drive arm plate, a stop located on an inside surface of the coin receiving machine above the contact surface of said drive arm, and a torsion spring, said drive arm being rotatably positioned on said shaft, said torsion spring linking said drive arm to said drive arm plate, thereby allowing said torsion spring to absorb excess force and thereby preventing damage to said mechanism in the event the coin return lever is turned with excess force.

12. The coin receiving mechanism of claim 11, further comprising a coin shutter means, said coin shutter means having a flat planar face with a coin slot defined therethrough, a shutter roller at its bottom portion, said coin shutter being pivoted at a pivot point, and a spring means to bias said coin shutter to return to a position to align said coin slot in said coin shutter with a coin slot located on the front of the coin receiving machine, wherein when said member is activated by turning, said lower curved lobe portion makes contact with said shutter roller, thereby causing said coin shutter to rotate on its pivot point and move said coin slot in said coin shutter out of alignment with the coin slot on the coin receiving machine, thereby preventing additional foreign objects from being introduced into said coin chute.

13. The coin receiving mechanism of claim 12 further comprising a pivoted rocker member, said rocker member being pivotally connected at a top end to said second end of said first link, said rocker being pivoted at a center portion on said front wall of said mounting frame, and said rocker member connecting with and activating a release door of the coin acceptor/coin counter device when said mechanism is activated.

14. The coin receiving mechanism of claim 9 wherein said inside surfaces of said coin chute walls have a plurality of parallel grooves defining a plurality of ribs formed thereon in the direction of said coin path and a plurality of groove blocks located between said parallel ribs in said parallel grooves at various intervals therebetween.

15. The coin receiving mechanism of claim 9 wherein said coin chute walls in different vertical planes when in their unactivated position to define a coin chute path lying in different vertical planes.

16. A coin receiving mechanism having a foreign object release device for us with coin receiving machine and with a coin acceptor/counter device, comprising:

a mounting frame having a front wall, a side wall and a rear wall;

a coin chute having first and second coin chute wall sections with an upper and lower portion and having an inner surface, said coin chute wall sections being pivoted at said top portion by a top rod bridging said front and rear walls of said mounting frame, said coin chute walls lying in a vertical plane when in their unactivated position to define a coin chute path lying in a vertical plane, said left and right coin chute wall sections each having a plurality of planar sections, at least two of which lie in a first direction in different planes and at least one of said planar sections lying in a second direction offset at an angle from said first direction to define a zigzagged and angled coin chute path;

a coin return lever means having a coin return lever and a drive arm with a contact surface, said drive arm being activated by said coin return lever;

a wall spreading means comprising a member having an upper portion, a middle portion and lower curved lobe portion, said member being pivoted by a pivot pin at its middle portion to said front wall of said mounting frame and said member having a roller rotatably pivoted near its upper portion, a first link having two ends, said first link being pivotally connected at its first end to said member and pivotally connected at its second end to said lower portion of said first coin chute wall, a second link having two ends, said second link being pivotally connected at its first end to said member and pivotally connected at its second end to said lower portion of said second coin chute wall, said first end of said link being pivoted to said member closer to said pivot pin than is said second link; and a coin shutter, said coin shutter having a surface with a coin slot defined therein, a shutter roller rotatably pivoted on a lower portion of said coin shutter, said coin shutter being pivoted to said front wall of said mounting frame, and a spring means to bias said coin shutter to return to a position aligning said coin slot in said coin shutter with a coin slot located on the front of the coin receiving machine, wherein said wall spreading mechanism is activated when said coin return lever is turned, causing said contact surface of said drive arm to push on said cam roller, thereby turning said cam member on its pivot pin and causing said first and second linking arm to spread said coin chute walls, said second coin chute wall section being opened wider than said first coin chute wall section, and thereby ejecting any foreign objects previously placed therebetween, and wherein when said member is rotated, its lower curved lobe portion contacts with said shutter roller, thereby rotating said coin shutter on its pivot point and moving said coin slot in said coin shutter out of alignment with the coin slot located on the front of the coin receiving machine, thereby preventing additional objects from being introduced into said coin chute path.

17. The coin receiving mechanism of claim 16, wherein said coin return lever means further comprises a drive arm plate, a shaft connecting said coin return lever rigidly to said drive arm plate, a stop located on an inside surface of the coin receiving machine above the contact surface of said drive arm, and a torsion spring, said drive arm being rotatably positioned on said shaft, said torsion spring linking said drive arm to said drive arm plate, thereby allowing said torsion spring to absorb the excess force and thereby preventing damage to said mechanism in the event the coin return lever is turned with excess force.

18. The coin receiving mechanism of claim 16 further comprising a pivoted rocker member, said rocker member being pivotally connected at a top end to said second end of said first link, said rocker being pivoted at a center portion on said front wall of said mounting frame, and said rocker member connecting with and activating a release door of the coin acceptor/coin counter device when said mechanism is activated.

19. A coin receiving mechanism having a foreign object release device for use with coin receiving machines and with a coin acceptor/counter device, comprising:

a mounting frame;

a coin chute having first and second coin chute walls, each wall having an inner surface and a bottom portion, said coin chute walls being pivoted together and with respect to said frame by a rod supported by said mounting frame, said first and second coin chute walls each having a plurality of planar sections at least two of which lie in a first direction in different planes and at least one of said planar sections lying in a second direction offset at an angle from said first direction to define a zigzagged and angled coin chute path;

a coin return operator;

a wall spreading means activated in response to turning said coin return operator for causing said first and second coin chute walls to move from an inactivated position with the coin chute walls disposed parallel to each other to an activated position wherein the coin chute walls open at their bottom portions, said second coin chute wall swinging open more widely than said first coin chute wall, said movement of said walls causing foreign objects caught therebetween to be ejected from between the walls, thereby clearing the coin chute path.

20. The coin receiving mechanism of claim 19 wherein said inside surfaces of said coin chute walls have a plurality of parallel grooves defining a plurality of ribs formed thereon in the direction of said coin path and a plurality of groove blocks located between said parallel ribs in said parallel grooves at various intervals therebetween.

21. The coin receiving mechanism of claim 19 wherein said coin chute walls lie in different vertical planes when in their inactivated position to define a coin chute path lying in different vertical planes.

* * * * *